US006470847B2

(12) United States Patent
Kawamoto

(10) Patent No.: US 6,470,847 B2
(45) Date of Patent: Oct. 29, 2002

(54) OIL FILTER AND OIL COOLER MOUNTING ARRANGEMENT FOR A FOUR-CYCLE MOTORCYCLE ENGINE

(75) Inventor: Hitoshi Kawamoto, Hamamatsu (JP)

(73) Assignee: Suzuki Motor Corporation, Shizuoka-Ken (JP)

( * ) Notice: Subject to any disclaimer, the term of this patent is extended or adjusted under 35 U.S.C. 154(b) by 100 days.

(21) Appl. No.: 09/757,550

(22) Filed: Jan. 10, 2001

(65) Prior Publication Data

US 2001/0015190 A1 Aug. 23, 2001

(30) Foreign Application Priority Data

Feb. 23, 2000 (JP) ..... 2000-046278

(51) Int. Cl.[7] ..... F01M 11/03
(52) U.S. Cl. ..... 123/196 R; 123/196 A
(58) Field of Search ..... 123/196 R, 196 A, 123/198 R, 195 A

(56) References Cited

U.S. PATENT DOCUMENTS 4,476,951 A * 10/1984 Ito ..... 123/195 A
5,199,395 A * 4/1993 Mizumura et al. ..... 123/196 A
5,235,944 A * 8/1993 Adachi ..... 123/196 R
5,297,511 A * 3/1994 Suzuki ..... 123/196 R
5,433,177 A * 7/1995 Suzuki ..... 123/196 R
5,495,833 A * 3/1996 Ishizaka et al. ..... 123/196 R
5,653,303 A * 8/1997 Kawamoto ..... 180/219
5,857,442 A * 1/1999 Sumi ..... 123/196 R
6,047,667 A * 4/2000 Leppanen et al. ..... 123/196 R
6,116,205 A * 9/2000 Troxler et al. ..... 123/196 R

FOREIGN PATENT DOCUMENTS

JP 01211609 A 8/1989
JP 07-011955 1/1995
JP 11-182260 7/1999

* cited by examiner

*Primary Examiner*—Noah P. Kamen
*Assistant Examiner*—Jason Benton
(74) *Attorney, Agent, or Firm*—Darby & Darby

(57) ABSTRACT

The oil cooler has four fastening sites for fastening bolts, two sites on each side of the oil cooler when viewed from the front. The exhaust pipes are arranged so that spacings between exhaust pipes are arranged at least in front of the center of the oil filter and in front of the inner fastening sites of the oil cooler, respectively.

8 Claims, 6 Drawing Sheets

OIL FILTER AND OIL COOLER MOUNTING ARRANGEMENT FOR A FOUR-CYCLE MOTORCYCLE ENGINE

BACKGROUND OF THE INVENTION (1) Field of the Invention

The present invention relates to an oil filter and oil cooler mounting arrangement for a four-cycle, inline multi-cylinder motorcycle engine having a multiple number of exhaust pipes.

(2) Description of the Prior Art

In many motorcycles having a four-cycle multi-cylinder engine mounted thereon, an inline multi-cylinder engine unit having its multiple cylinders inclined forwards with its crankshaft extending widthwise across the bodywork is arranged and suspended in the lower front part of the motorcycle bodywork. In the exhaust system of such an engine, exhaust pipes connected to exhaust ports on the upper front side of the forward tilting cylinders extend from the front part of the engine unit downwards and further are bent around the bottom of the engine unit and directed to the rear so that they are connected together or individually to the muffler arranged in the rear part of the motorcycle body.

In a motorcycle of the above type, in order to minimize the sideward bulges of the body, the oil filter and the oil cooler of the engine unit are attached to the front part of the engine case. In particular, there are motorcycles with their bodywork totally covered by a fairing in which the oil filter and oil cooler are arranged side by side in their front view.

In this case, the exhaust pipes are laid out in front of and under the oil filter and oil cooler. Therefore, as matters stand, the exhaust pipes will interfere with the oil filter and the oil cooler when they need to be replaced, producing difficulties in mechanical maintenance.

As a prior art oil filter layout configuration of an engine unit of this type, it is possible to provide a configuration by the combination of the disclosure of Japanese Patent Application Laid-Open Hei 7 No.11955 wherein the oil cooler is arranged at the bottom of the oil filter and that of Japanese Patent Application Laid-Open Hei 1 No.211609 wherein a multiple number of exhaust pipes located in front of the oil filter are separated to the sides forming a space therebetween.

However, the combination of these prior arts means that the oil cooler with an oil filter attached in the front thereof should be attached to the engine. Therefore, in order to avoid interference with the exhaust pipes, both the oil cooler and the oil filter have to be compact, or of a small volume. Since the performance of cooling the oil lowers if the volume of the oil cooler is small, oil film may be used up or cavitation might occur when the engine is run at a high speed over a long period.

In contrast, there is a method in that the oil filter and oil cooler are mounted side by side in the lower front part of the engine(see Japanese Patent Application Laid-Open Hei 11 No.182260). However, it is defined in the publication of this motorcycle that the projected ends of the oil filter and oil cooler are located within the space enclosed by the crankcase and the exhaust pipes arranged in front of the crankcase. Therefore, when tools are inserted into the space to fasten or unfasten bolts etc., upon attachment and detachment of the oil filter and oil cooler, turning of the tools interferes with the exhaust pipes, so that the exhaust pipes need to be detached, resulting in poor work performance.

SUMMARY OF THE INVENTION

The present invention has been devised in view of the above problems, and it is therefore an object of the present invention to provide an oil filter and oil cooler mounting arrangement for a four-cycle motorcycle engine, which permits fastening and unfastening tools to be inserted and turned upon attachment and detachment of the oil filter and oil cooler without inference of the exhaust pipes, providing improved work performance.

In order to achieve the above object, the present invention is configured as follows:

In accordance with the first aspect of the present invention, an oil filter and oil cooler mounting arrangement for a four-cycle engine for use in a motorcycle has an inline multi-cylinder engine which comprises: a crankshaft laid out widthwise across the bodywork and mounted in the front lower part of the bodywork; an oil pan having both side surfaces inclined; and a multiple number of exhaust pipes extended from the front upper part of the engine to the lower part of the engine and bent toward the rear while being split to the left and right along the inclined side surfaces, and is characterized in that an oil filter and oil cooler are arranged side by side and projected forwards in the lower front part of the engine; the oil cooler has its fastening sites at both sides when viewed from the front; and the exhaust pipes are arranged so that spacings are formed between the two adjacent exhaust pipes, at least, in front of the center of the oil filter and in front of the inner fastening sites of the oil cooler, respectively.

In accordance with the second aspect of the present invention, the oil filter and oil cooler mounting arrangement for a four-cycle engine for use in a motorcycle having the above first feature is characterized in that at least one of the exhaust pipes is extended vertically in front of and between the center of the oil filter and the inner fastening sites of the oil cooler.

In accordance with the third aspect of the present invention, the oil filter and oil cooler mounting arrangement for a four-cycle engine for use in a motorcycle having the above first feature is characterized in that a cooling water hose is arranged close to the outer side, with respect to the bodywork width, of the oil cooler and the outer fastening sites of the oil cooler are arranged at positions above and below the cooling water hose, when viewed from the front.

In accordance with the fourth aspect of the present invention, the oil filter and oil cooler mounting arrangement for a four-cycle engine for use in a motorcycle having the above second feature is characterized in that a cooling water hose is arranged close to the outer side, with respect to the bodywork width, of the oil cooler and the outer fastening sites of the oil cooler are arranged at positions above and below the cooling water hose, when viewed from the front.

In accordance with the fifth aspect of the present invention, the oil filter and oil cooler mounting arrangement for a four-cycle engine for use in a motorcycle having one of the above first through fourth features is characterized in that the exhaust pipes are positioned so that the spacings between the adjacent exhaust pipes are positioned in front of the oil filter center and in front of the inner and outer fastening sites of the oil cooler, respectively.

According to the present invention, since the oil filter and oil cooler are arranged side by side and projected forwards in the lower front part of the engine, it is possible to enlarge the oil filter and oil cooler in both height and in radius, and hence enlarge their capacities without having to worry about any obstacles.

The oil cooler has fastening sites at both sides when viewed from the front and the exhaust pipes are arranged so that spacings between two adjacent exhaust pipes are positioned, at least, in front of the center of the oil filter and in front of the inner fastening sites of the oil cooler, respectively. Since the oil filter and oil cooler are projected forwards and arranged at the lower front of the engine, it is necessary to form spacings between the exhaust pipes through which tools for attachment and detachment can be inserted. This is why the spacings between two adjacent exhaust pipes are positioned in front of the center of the oil filter and in front of the inner fastening sites of the oil cooler, respectively. In this case, since the oil filter is attached or detached by fitting a tool over the oil filter and turning the tool, it is necessary to provide the insert space for the tool. As to the oil cooler, the oil cooler has fastening sites at both sides thereof when viewed from the front. The fastening sites on the outer side are accessible to the tool which is inserted from the side of the engine, whereas the fastening sites on the inner side are not accessible to the tool, which is inserted from the side of the engine, because they are enclosed on both sides by the oil filter and oil cooler. This is why the spacing is positioned between the two exhaust pipes in front of the inner fastening sites of the oil cooler so as to allow the tool to be inserted.

In the present invention, since, regardless of the number of cylinders, at least one of the exhaust pipes is extended vertically in front of and between the center of the oil filter and the inner fastening sites of the oil cooler, it is possible to arrange the spacings between the exhaust pipes in front of the center of the oil filter and in front of the inner side fastening sites of the oil cooler.

In order to secure high enough a capacity of the oil cooler for improved cooling performance, it is necessary to extend the oil cooler outwards as closely to the engine width as possible. The engine hose connecting the radiator and the water pump is preferably arranged as inwardly (closely to the oil cooler) as possible in order to assume a large bank angle. As a result, since the hose is arranged close to the oil cooler, the cooling water hose is positioned close to the outer side, with respect to the bodywork width, of the cooler, and the outer fastening sites of the oil cooler are arranged at upper and lower positions set away from the cooling water hose when viewed from the front, thus providing the space for the tool to be inserted for fixing.

In addition to the spacings formed in front of the oil filter center and in front of the inner fastening sites of the oil cooler, another spacing may be formed between the exhaust pipes in front of the outer fastening sites of the oil cooler, so that the tool can be inserted from the spacing. This configuration further improves the work performance.

DESCRIPTION OF THE PREFERRED EMBODIMENTS

The embodiment of the present invention will hereinafter be described in detail with reference to the accompanying drawings.

Figure 1:
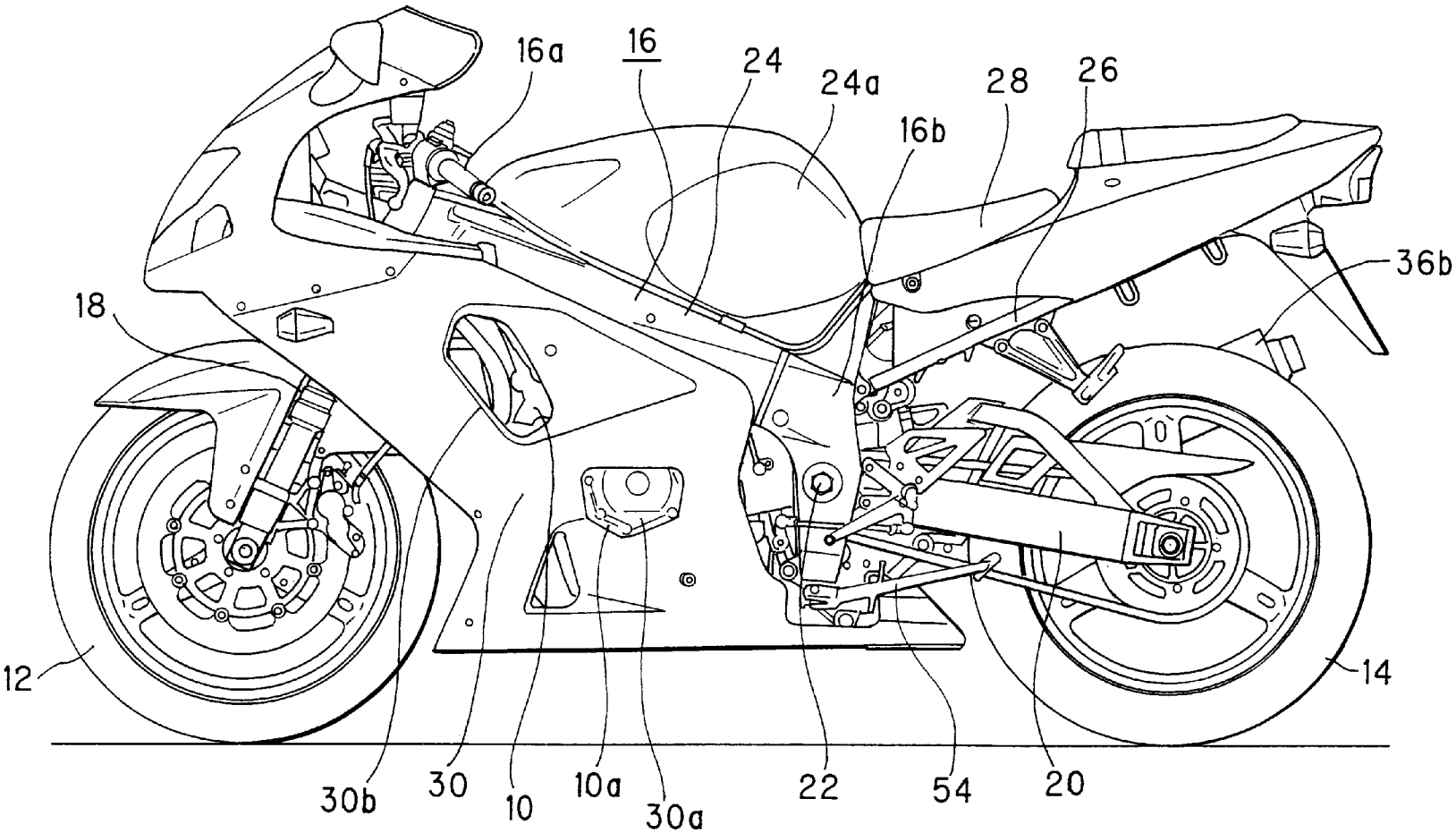
FIG. 1 is a side view showing a motorcycle as an example of the embodiment of the present invention.
Figure 2:
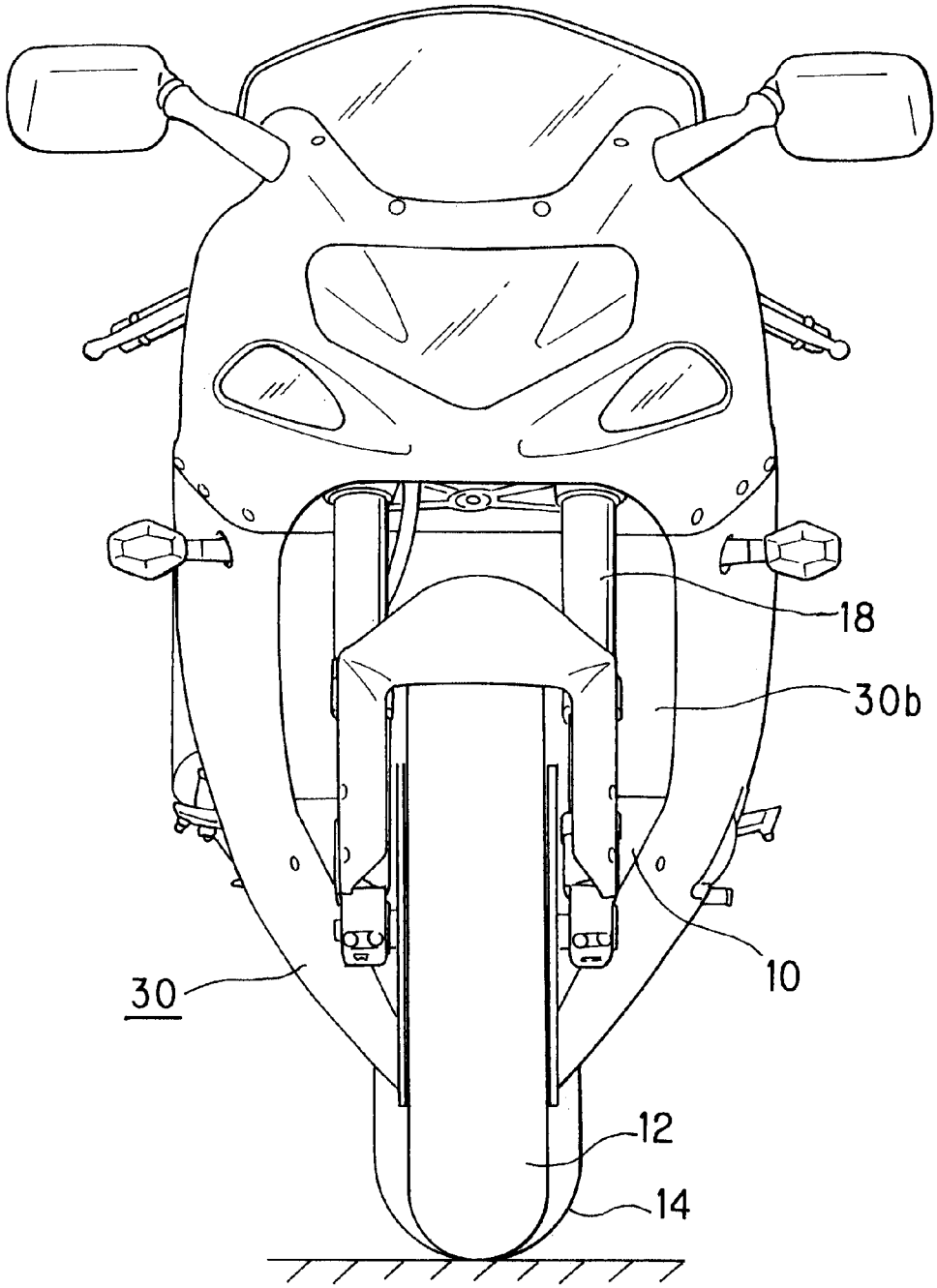
FIG. 2 is a front view showing the motorcycle.
Figure 3:
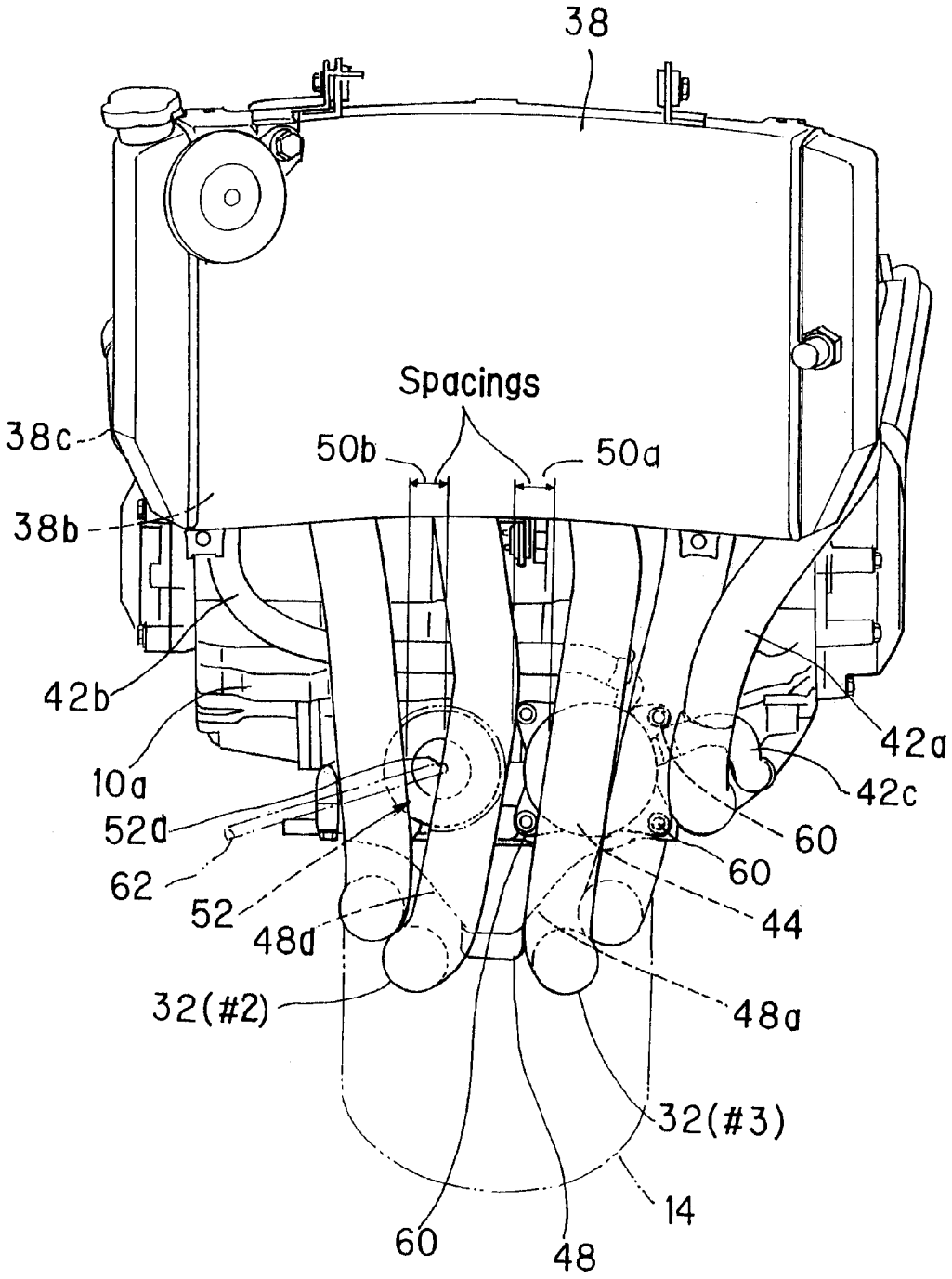
FIG. 3 is a front view showing the detail of the engine.
Figure 4:
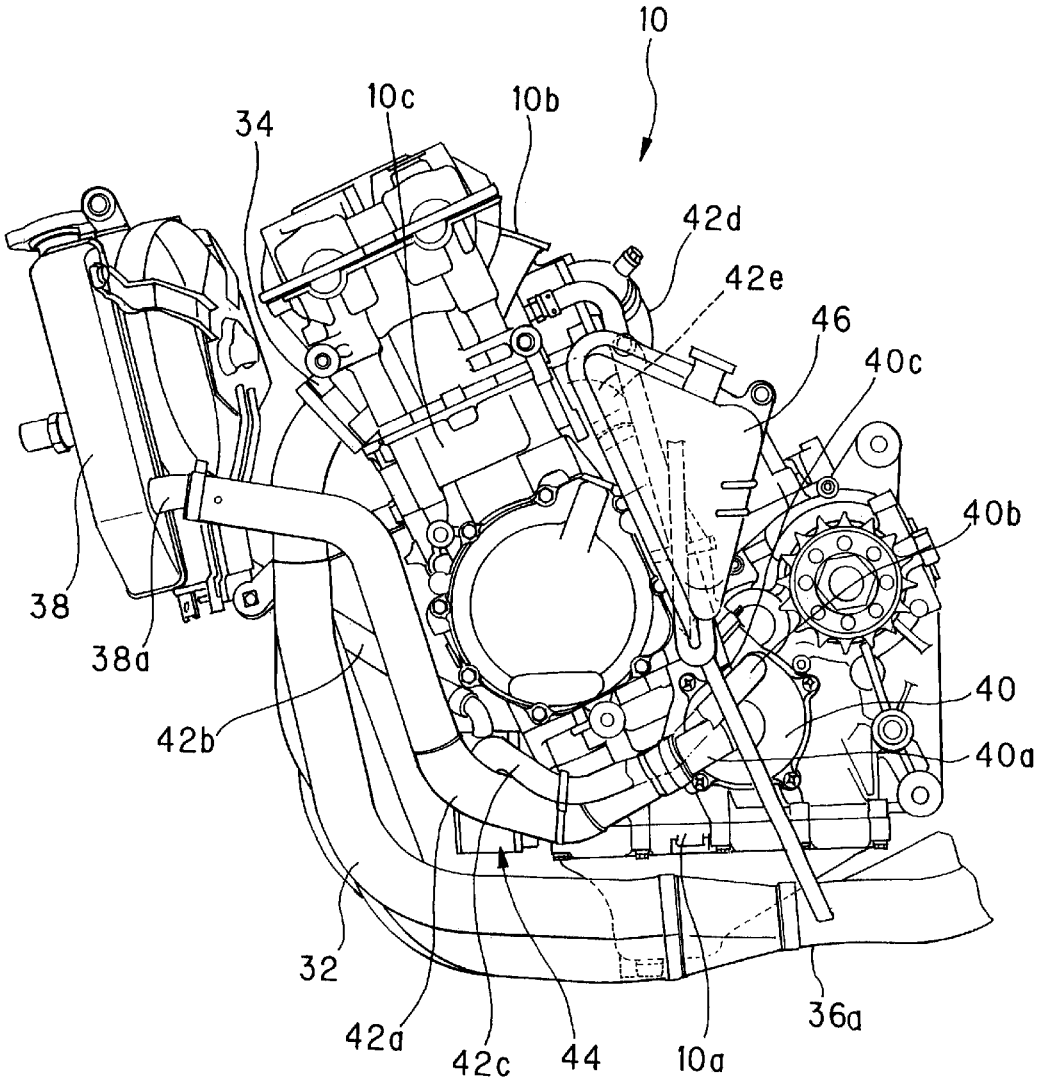
FIG. 4 is a left side view of the engine.
Figure 5:
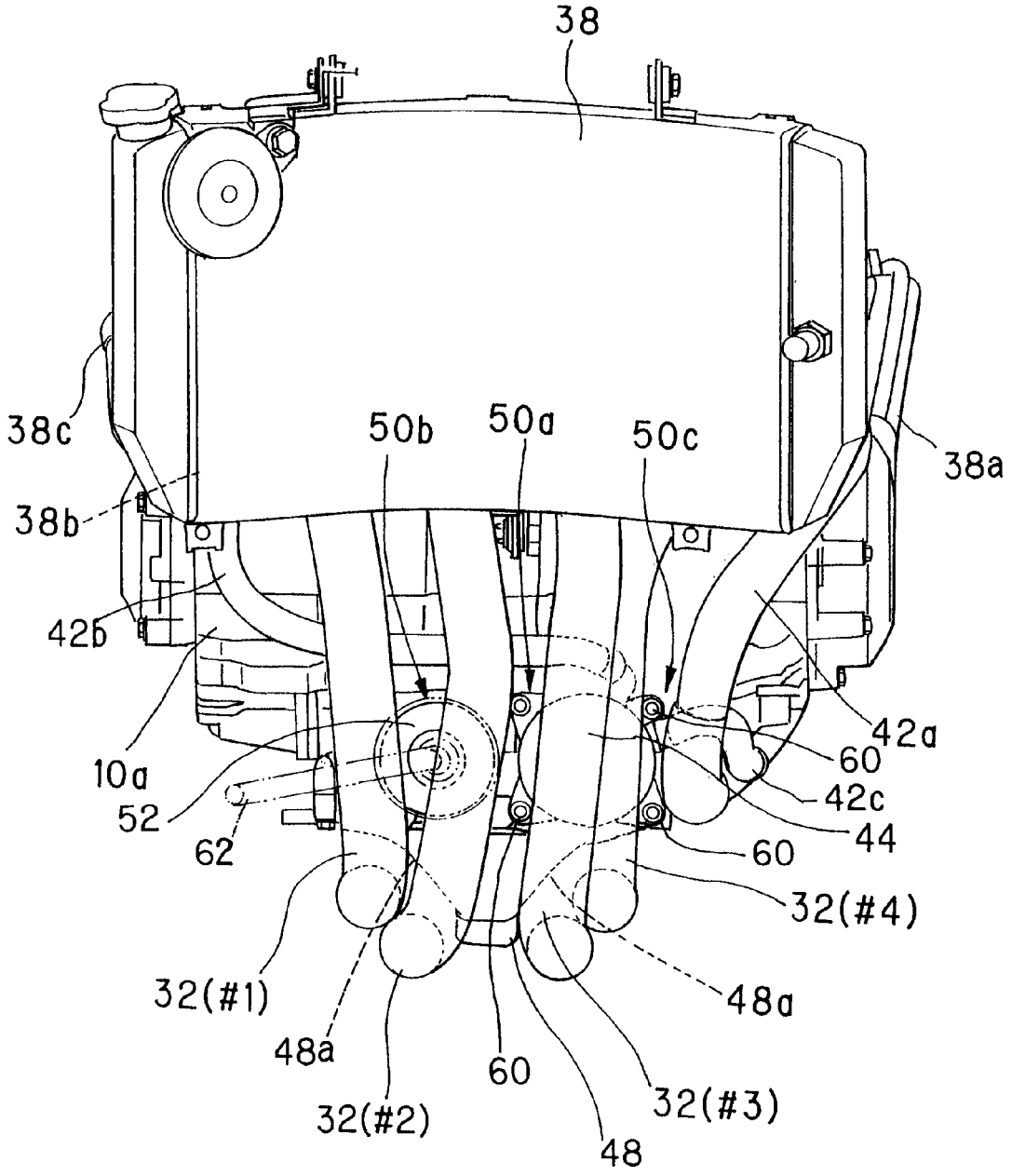
FIG. 5 is a front view showing an engine of the first variational example.
Figure 6:
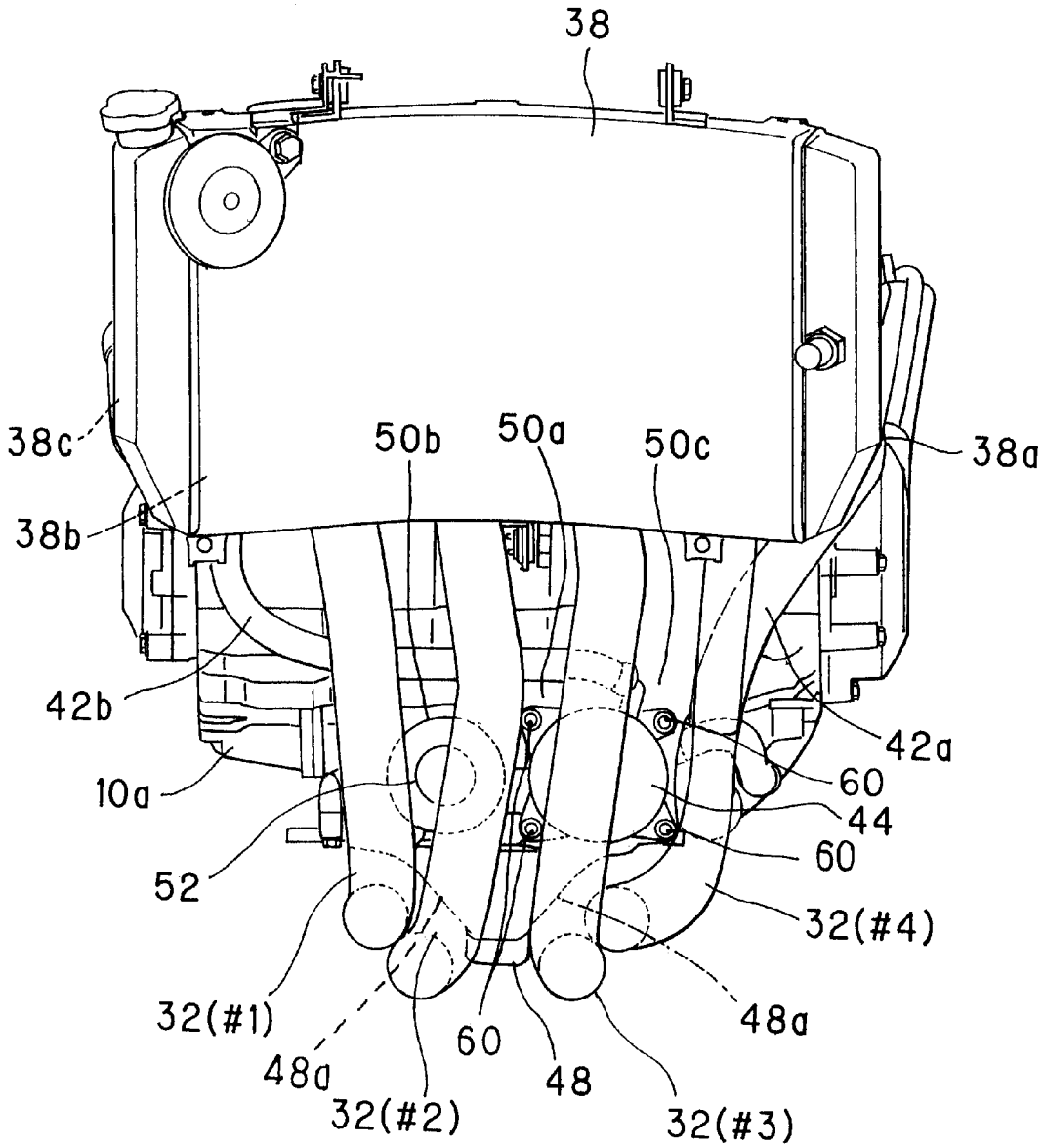
FIG. 6 is a front view showing an engine of the second variational example.

FIGS. 1 through 6 show an embodiment of the present invention. FIG. 1 is a side view of a motorcycle; FIG. 2 is its front view; FIG. 3 is a front view showing the detail of the engine; FIG. 4 is a left side view of the engine; FIG. 5 is a front view showing an engine of the first variational example; and FIG. 6 is a front view showing an engine of the second variational example.

As shown in FIGS. 1 and 2, the motorcycle of this embodiment has an inline multi-cylinder engine 10 with its crankshaft arranged widthwise across the motorcycle body and mounted in the front lower part of the bodywork between front and rear wheels, designated at 12 and 14, respectively.

Engine 10 is suspended by a frame 16. Arranged at the front end of frame 16 is a head pipe 16*a* for rotatably supporting steering forks 18 (for bearing front wheel 12) while a main tube 16*b* having a pivot shaft 22 (for axially supporting a rear swing arm 20 for supporting the rear wheel) formed therewith is arranged at the rear end. Frame 16 is configured of a twin tube type and a pair of tank tubes 24 of aluminum rectangle pipe having a rectangular section are extended from steering head pipe 16*a* in the lower and rear direction. A fuel tank 24*a* is mounted on and fixed to these tank tubes 24. Seat rails 26 are extended from the upper rear side of main tube 16*b* in the upper and rear direction and a seat 28 is placed thereon.

A fairing 30 covering the motorcycle covers the bodywork from the front steering above front wheel 12 up to the rear at main tube 16*b*, enclosing engine 10 which is suspended by frame 16, having an overall bullet configuration so as to reduce air resistance while travelling. In order to shape fairing 30 as close to the bodywork as possible, a through-opening 30*a* to expose the magneto cover of an engine case 10*a* is formed. Further, vent windows 30*b* are formed on the front and side faces in order to provide ventilation. A kickstand (prop stand)54 is pivotally attached at the left-side lower end of main tube 16*b* and supported with a spring so that the stand can be kept at the supporting and retracted positions.

As shown in FIGS. 3 and 4, engine 10 has four cylinders (#1 to #4) each having an exhaust port 34 on the front top thereof, which is coupled to an exhaust pipe 32. Each exhaust pipe 32 is extended downwards from the front part of engine 10 and further extended towards the rear, being an overall L-shape along the engine's front lower part. Exhaust pipes 32 are gathered below the engine at the gathering 36*a*, which is coupled to a muffler 36*b* disposed in the rear body.

As a cooling system of engine 10, a radiator 38 is disposed in front of engine 10 while a water pump 40 is arranged at a rear lower site of engine 10. The intake port, designated at 40*a*, of water pump 40 is connected to an outlet 38*a* of radiator 38, by an intake water hose 42*a* laid out on the lower left side of the engine. One of the inlet ports to radiator 38, designated at 38*b*, is coupled to an aftermentioned water-cooled type oil cooler 44 by way of a water hose 42*b*. A water hose 42*c* is disposed to provide communication from this oil cooler 44 to the outlet port 40*b* of water pump 40. The other inlet port 38*c* to radiator 38 is coupled to the cylinder head 10*b* of engine 10 by way of a water hose 42*d*. A water hose 42*e* is disposed to provide communication from the cylinder block 10*c* to an ejection port 40*c* of water pump 40. A reservoir tank 46 for storing cooling water is arranged above water pump 40.

Provided for engine case 10*a* at the bottom of engine 10 is an oil pan 48 projected downwards with its side faces (48*a*, 48*a*) inclined forming a downward ridge from the front view. In the engine 10, four exhaust pipes 32–32 from cylinders #1 to #4 are split, two at each side and extended along the respective inclined side faces 48*a*, 48*a* to the rear so as to create spacings 50*a* and 50*b* between the two centered exhaust pipes 32 and 32 for cylinders #2 and #3 and between the adjacent exhaust pipes 32 and 32 for cylinders #1 and #2, respectively.

An oil filter 52 and oil cooler 44, both being substantially cylindrical are arranged widthwise of the vehicle, on the left and right, being projected forwards, in the lower front of engine case 10*a* of engine 10. Oil filter 52 is a container having a filter element in an external case with an oil passage (not shown) connected to the engine case 10*a* side.

Here, as shown in FIG. 3, oil cooler 44 has four fastening sites 60–60 for fixing bolts, two at each side or left and right, when viewed from the front. Exhaust pipes 32–32 are arranged so that spacings 50*a* and 50*b* between two adjacent exhaust pipes 32 and 32 are positioned, at least, in front of the center, designated at 52*a*, of oil filter 52 and in front of the inner fastening sites of oil cooler 44, respectively.

In this embodiment, since oil filter 52 and oil cooler 44 are arranged side by side and projected forwards in the lower front part of engine 10, it is possible to enlarge oil filter 52 and oil cooler 44 in both height and in radius, and hence enlarge their capacities without having to worry about any obstacles.

Oil cooler 44 has fastening sites 60–60 at both sides when viewed from the front and exhaust pipes 32–32 are arranged so that spacings 50*a* and 50*b* between the aforementioned two adjacent exhaust pipes 32 and 32 are positioned, at least, in front of the center, designated at 52*a*, of the oil filter and in front of the inner fastening sites 60 of oil cooler 44, respectively. Since oil filter 52 and oil cooler 44 are projected forwards and arranged in the lower front part of engine case 10*a* of engine 10, it is necessary to form spacings between exhaust pipes 32–32 through which tools (designated at 62) for attachment and detachment can be inserted. This is why spacings 50*a* and 50*b* between two adjacent exhaust pipes 32 and 32 are positioned in front of the center 52*a* of the oil filter and in front of inner fastening sites 60 of oil cooler 44, respectively. In this case, since oil filter 52 is attached or detached by fitting tool 62 over oil filter 52 and turning the tool 62, it is necessary to provide the insert space for the tool. The above-mentioned spacing 50*b* serves as the insert space and allows the tool 62 to be inserted. As to oil cooler 44, the oil cooler has fastening sites 60–60 at both sides thereof when viewed from the front. The fastening sites 60 on the outer side are accessible to the tool (nut wrench, etc.) which is inserted from the side of engine 10 (from the left side in this embodiment), whereas the fastening sites 60 on the inner side are not accessible to the tool, which is inserted from the side of engine 10, because they are enclosed on both sides by oil filter 52 and oil cooler 44. This is why spacing 50*a* is positioned between the two exhaust pipes 32 and 32 for #2 and #3 cylinders in front of inner fastening sites 60 of oil cooler 44.

Since, regardless of the number of the exhaust pipes, at least one of exhaust pipes 32(the exhaust pipe 32 for #2 cylinder in this embodiment) is extended vertically in front of and between the center 52*a* of oil filter 52 and the inner fastening sites 60 of oil cooler 44, it is possible to arrange exhaust pipes 32–32 so that spacings 50*b* and 50*a* between the adjacent exhaust pipes 32 and 32 are positioned in front of the center 52*a* of oil filter and in front of the inner side fastening sites 60 of oil cooler 44, respectively.

In order to secure high enough a capacity of oil cooler for improved cooling performance, it is necessary to extend oil cooler 44 outwards as closely to the engine width as possible. Engine hose 42*a* connecting radiator 38 and water pump 40 is preferably arranged as inwardly (closely to oil cooler 44) as possible in order to assume a large bank angle. As a result, since hose 42*a* is arranged close to oil cooler 44, cooling water hose 42*a* is positioned close to the outer side, with respect to the bodywork width, of cooler 44 as shown in FIG.3, and outer fastening sites 60 and 60 of the oil cooler are arranged at positions above and below and set away from cooling water hose 42*a* when viewed from the front, whereby it is possible to provide the space for the tool to be inserted for attachment and detachment.

In the first variational example shown in FIG.5, the exhaust pipes 32 and 32 for #3 and #4 cylinders are positioned close to each other producing a spacing 50*c* which allows the outer side fastening sites 60 of oil cooler 44 to be seen from the front. In the second variational example shown in FIG. 6, the exhaust pipe 32 for #4 cylinder is set apart from oil cooler 44 producing a spacing 50*c* which allows the outer side fastening sites 60 of oil cooler 44 to be seen from the front. According to these variational examples, the spacings are formed in front of oil filter center 52*a* and in front of inner fastening sites 60 of oil cooler 44, and also spacing 50*c* is formed between the exhaust pipes(for #3 and #4 cylinders) 32 and 32 and positioned in front of the outer fastening sites 60 of oil cooler 44, so that the tool can be inserted from the spacings. Accordingly, all the fastening sites can be accessible to tool 62 from the front side, thus providing a further improved operability.

The oil filter and oil cooler mounting arrangement for a four-cycle motorcycle engine of the present invention should not be limited to the above embodiments. For example, the number of the cylinders of the engine is not limited to four but the present invention is applicable to an engine having a greater number of cylinders.

As has been described, according to the thus configured oil filter and oil cooler mounting arrangement for a four-cycle motorcycle engine, upon replacement of the oil filter and oil cooler, the fixing tools can be used or turned without interference with the exhaust pipes, thus making it possible to improve the maintenance work on the oil filter and oil cooler.

What is claimed is:

1. An oil filter and oil cooler mounting arrangement for a four-cycle engine for use in a motorcycle wherein an inline multi-cylinder engine comprises: a crankshaft laid out widthwise across the bodywork and mounted in the front lower part of the bodywork; an oil pan having both side surfaces inclined; and a multiple number of exhaust pipes extended from the front upper part of the engine to the lower part of the engine and bent toward the rear while being split to the left and right along the inclined side surfaces, characterized in that an oil filter and oil cooler are arranged side by side and projected forwards in the lower front part of the engine; the oil cooler has its fastening sites at both sides when viewed from the front; and the exhaust pipes are arranged so that spacings are formed between the two adjacent exhaust pipes, at least, in front of the center of the oil filter and in front of the inner fastening sites of the oil cooler, respectively.

2. The oil filter and oil cooler mounting arrangement for a four-cycle engine for use in a motorcycle according to claim 1, wherein at least one of the exhaust pipes is extended vertically in front of and between the center of the oil filter and the inner fastening sites of the oil cooler.

3. The oil filter and oil cooler mounting arrangement for a four-cycle engine for use in a motorcycle according to claim 1, wherein a cooling water hose is arranged close to the outer side, with respect to the bodywork width, of the oil cooler and the outer fastening sites of the oil cooler are arranged at positions above and below the cooling water hose, when viewed from the front.

4. The oil filter and oil cooler mounting arrangement for a four-cycle engine for use in a motorcycle according to claim 2, wherein a cooling water hose is arranged close to the outer side, with respect to the bodywork width, of the oil cooler and the outer fastening sites of the oil cooler are arranged at positions above and below the cooling water hose, when viewed from the front.

5. The oil filter and oil cooler mounting arrangement for a four-cycle engine for use in a motorcycle according to claim 1, wherein the exhaust pipes are positioned so that the spacings between the adjacent exhaust pipes are positioned in front of the oil filter center and in front of the inner and outer fastening sites of the oil cooler, respectively.

6. The oil filter and oil cooler mounting arrangement for a four-cycle engine for use in a motorcycle according to claim 2, wherein the exhaust pipes are positioned so that the spacings between the adjacent exhaust pipes are positioned in front of the oil filter center and in front of the inner and outer fastening sites of the oil cooler, respectively.

7. The oil filter and oil cooler mounting arrangement for a four-cycle engine for use in a motorcycle according to claim 3, wherein the exhaust pipes are positioned so that the spacings between the adjacent exhaust pipes are positioned in front of the oil filter center and in front of the inner and outer fastening sites of the oil cooler, respectively.

8. The oil filter and oil cooler mounting arrangement for a four-cycle engine for use in a motorcycle according to claim 4, wherein the exhaust pipes are positioned so that the spacings between the adjacent exhaust pipes are positioned in front of the oil filter center and in front of the inner and outer fastening sites of the oil cooler, respectively.

* * * * *